US005941109A

United States Patent [19]

Johnson et al.

[11] Patent Number: 5,941,109

[45] Date of Patent: Aug. 24, 1999

[54] METHOD AND APPARATUS FOR THE REGISTRATION OF CONTAINERS

[75] Inventors: Brian D. Johnson, Sinclairville, N.Y.; Frank L. O 'Brien, Westminster, Colo.; Randall E. Carr, Ellicottville; Larry W. Ellis, Cattaraugus, both of N.Y.

[73] Assignee: Aluminum Company of America, Pittsburgh, Pa.

[21] Appl. No.: 08/916,213

[22] Filed: Aug. 22, 1997

Related U.S. Application Data

[63] Continuation of application No. 08/684,114, Jul. 19, 1996.

[51] Int. Cl.[6] ..... B21D 51/26

[52] U.S. Cl. ..... 72/17.3; 101/4; 198/394

[58] Field of Search ..... 198/394; 101/4; 220/671, 674; 72/17.3, 37, 105, 106, 379.4, 420

[56] References Cited

U.S. PATENT DOCUMENTS

| | | | |
|---|---|---|---|
| D. 283,011 | 3/1986 | Moloney et al. | D9/398 |
| D. 290,688 | 7/1987 | Moloney et al. | D9/398 |
| 744,231 | 11/1903 | Puddefoot . | |
| 2,630,204 | 3/1953 | Lichtenberg | 198/33 |
| 3,048,512 | 8/1962 | Nelson | 156/14 |
| 3,126,309 | 3/1964 | Manas et al. | 156/566 |
| 3,221,643 | 12/1965 | Rudolph et al. | 101/38 |
| 3,359,819 | 12/1967 | Veillette et al. | 74/409 |
| 3,451,523 | 6/1969 | Evans, Jr. et al. | 198/394 |
| 3,628,451 | 12/1971 | McClellan et al. | 198/394 |
| 4,266,685 | 5/1981 | Lee, Jr. | 220/74 |
| 4,399,675 | 8/1983 | Erdmann et al. | 72/37 |
| 4,428,474 | 1/1984 | Gau et al. | 198/394 |
| 4,487,048 | 12/1984 | Frei | 72/94 |
| 4,519,232 | 5/1985 | Traczyk et al. | 72/133 |
| 4,773,718 | 9/1988 | Weitzen et al. | 350/3.61 |
| 4,814,784 | 3/1989 | Pallmeyer | 343/882 |
| 4,854,442 | 8/1989 | Krooss | 198/400 |
| 4,954,044 | 9/1990 | Chizaki | 414/754 |
| 5,201,984 | 4/1993 | Bedin | 156/566 |
| 5,255,775 | 10/1993 | Buehren et al. | 198/395 |
| 5,261,261 | 11/1993 | Ramsey | 72/105 |
| 5,261,558 | 11/1993 | Claydon | 220/671 |
| 5,349,837 | 9/1994 | Halasz et al. | 72/94 |
| 5,360,314 | 11/1994 | Provost et al. | 414/755 |
| 5,397,021 | 3/1995 | Usui | 220/667 |

FOREIGN PATENT DOCUMENTS

| | | |
|---|---|---|
| 0399354 | 11/1990 | European Pat. Off. . |
| 0572758 | 3/1992 | European Pat. Off. . |
| 0492860 | 7/1992 | European Pat. Off. . |
| 0635452 | 1/1995 | European Pat. Off. . |
| 2342207 | 2/1976 | France . |
| 3408834 | 12/1984 | Germany . |
| 4140428 | 7/1991 | Germany . |
| 4-367432 | 12/1992 | Japan . |
| 247637 | 2/1926 | United Kingdom . |
| 1408091 | 10/1975 | United Kingdom . |
| 9515227 | 6/1995 | WIPO . |
| 9721505 | 6/1997 | WIPO . |

*Primary Examiner*—Lowell A. Larson
*Attorney, Agent, or Firm*—Thomas R. Trempus

[57] ABSTRACT

A can body embossing apparatus has a first mandrel with a first tooling member adapted to receive thereon a can body and a second mandrel with a second tooling member reciprocally movable from a first position distal the first tooling member to a second position proximate the first tooling member. In the second position, the can body side wall is engaged between the first tooling member and the second tooling member. The first tooling member defines one or more recessed portions therein and the second tooling member defines one or more protuberances extending therefrom and adapted to correspond with the recessed portions. The first mandrel and second mandrel are in mechanical communication throughout the reciprocal movement of the second mandrel such that the first and second tooling members rotate continuously with respect to each other and maintain a substantially constant relative position with respect to each other. The continuous side wall of the can body is conveyed between the first and second tooling members to effect the embossing of the side wall resulting in the formation of decorative embossed features in the side wall.

6 Claims, 10 Drawing Sheets

METHOD AND APPARATUS FOR THE REGISTRATION OF CONTAINERS

This application is a continuation of application Ser. No. 08/684,114 filed Jul. 19, 1996 pending.

FIELD OF THE INVENTION

This invention relates generally to two-piece containers typically used in the beer and beverage industry, and more particularly to an apparatus for the embossing of such containers in a manner that aligns the container so that the embossing of the container side wall is congruous with the graphics previously applied to the container.

BACKGROUND OF THE INVENTION

A two-piece container of the type used in the beer and beverage industry consists of a unitary body and a can end. The unitary body is typically formed through a drawing and ironing process. The can end typically consists of an end shell that is converted into an easy open style end. After the can body is filled with a product the converted end is seamed onto the open end of the body. Two-piece cans are predominantly formed from aluminum sheet product and are the most common type of metal container employed by the beer and beverage industry. Of critical importance in the packaging industry is the desire to enhance the appearance of the container in order to achieve a heightened level of product differentiation and consumer acceptance.

Various attempts have been made to enhance the overall appearance of the two-piece drawn and ironed aluminum container. These attempts have been two pronged. On the one hand, various efforts have been made to increase the appearance of the decorated can through the use of additional colors in the graphic art applied on the can body. For example, the decoration of cans has gone from four colors to six colors and now presently to eight different colors that can be applied by a single can body decorator apparatus. On the other hand, efforts have been made to modify the appearance of the container itself by further forming the can body itself. For example, it is known to produce a fluted appearance in the side wall of a can body such as disclosed in U.S. Pat. Nos. Des. 283,011 and Des. 290,688. A method and apparatus for processing containers to produce the designs illustrated in the aforementioned patents is disclosed in U.S. Pat. No. 5,349,837, the contents of which are incorporated herein by reference as if fully set forth. However, when a can body having a fluted side is pressurized, the fluted appearance on the consumer side of the container is lessened and the overall fluted appearance of the container diminished. The full impact of the fluted side wall may not be realized until the beverage container is opened and internal pressure equalized with the ambient. Additionally, while the fluted features are applied in a predetermined physical pattern, the pattern itself does not have any congruous or predetermined relationship with respect to the graphics that have been applied previously to the can body. The fluted pattern and the existing graphics do not represent an integrated artistic whole that heightens the visual impact of the container. The application of the fluted features is random. Accordingly, there remains a long-standing goal in the industry to provide a method and an apparatus that will coordinate the application of such features as fluting with the container's art work. Likewise, it has been a goal in the industry to provide a method for enhancing the appearance of a can body, such that the can body retains the features even when the can's contents are maintained under pressure.

It is therefore an object of this invention to provide both an apparatus and a method for the embossing of a can body side wall to enhance the appearance of the container wherein the embossing is applied in a predetermined manner that coordinates the embossing with the can's existing graphics or decoration.

It is also an object of the apparatus of this invention to provide a can body having features thereon that maintain their integrity even when the contents of the container are maintained under pressure.

It is still another object of this invention to provide an apparatus that can be readily integrated into a commercial can line to provide the selective and registered embossing of a decorated can body.

It is yet another object of this invention to provide a can body that exhibits an enhanced appearance through the application of registered embossing to the decoration or graphic art previously applied to the can.

SUMMARY OF THE INVENTION

According to the present invention, the body portion of a two piece container is further formed to incorporate a variety of features embossed on the side wall of the container body. According to one aspect of the instant invention, the can body side walls are embossed in a continuous process by means of an apparatus that includes a turret that is mounted for fixed rotation on a support column. The turret has a plurality of substantially identical embossing stations circumferentially disposed around the periphery of the turret. The turret rotates about the column, sequentially conveying each work station from a can body acquisition station, through loading, embossing, and unloading operations during a portion of the rotational travel of the turret, and finally to a can body discharge station. The can body is delivered to and removed from the apparatus of this invention by means of conventional conveyance systems.

Each embossing station includes a first mandrel supported for rotation about a fixed axis and a second mandrel supported for rotation about a reciprocating, second axis. The second axis reciprocates between a first location proximate the first axis and a second location distal the first axis in a manner to be described below. The reciprocal movement of the second mandrel is controlled by a cam mechanism disposed on the support column. Each embossing station incorporates a pair of tooling members, each associated with one of the first or second mandrels, one of the pair of tooling members being a female member, the other a male member. The tooling member associated with the first mandrel constitutes the inner tooling member, in that during the embossing operation, the can body substantially encapsulates it. The inner tooling member is in contact with the product side of the container's side wall. Preferably, the inner tooling also constitutes the female tooling member. The tooling member associated with the second mandrel constitutes the outer tooling member, in that during the embossing operation it is in contact with the consumer side of the container's side wall. This outer tooling member constitutes the male tooling member. The inner and outer tooling members when in the first position proximate each other, are sufficiently close so that rotating tooling members engage the continuous side wall of the can body, initiating the embossing of the can body according to the apparatus of this invention. The tooling members are rotated approximately one full revolution (360°) in order to further form substantially the entire continuous side wall.

Turning to the apparatus, the rotational movement of the first mandrel is provided by a spur gear fixedly attached to the mandrel and riding along a sun gear fixed on the column. As the turret conveys the work station about the column, the first mandrel spur gear, which is rotating about its axis is in contact with sun gear. Preferably, the gear ratio between the first mandrel spur gear and the column sun gear is such that for one complete revolution of the turret about the column, each mandrel completes three complete rotations about its axis. The first and second mandrels are in mechanical communication with each other so as to be continuously rotating at a substantially constant speed and in a synchronized relationship with respect to each other. This synchronized relationship is maintained while the second mandrel reciprocates between the first and second position through a combination of the first mandrel spur gear and an anti-backlash spur gear fixedly attached to the second mandrel. The anti-backlash gear includes a spring-loaded split face that is biased to urge one face of the gear into misalignment with the other face. This "forced misalignment" maintains the teeth of the anti-backlash gear of the second mandrel in continuous contact with the teeth of the spur gear of the first mandrel even as the second mandrel moves away from and then back into working engagement with the first mandrel. The continuous contact of the gears maintains the first mandrel and the second mandrel in a synchronized, rotational position with respect to each other.

Both the fixed and the movable mandrel support a tooling member thereon. When the second mandrel is in the first position proximate the first mandrel, both tooling members are positioned to be in contact with a can body that has been loaded onto the first mandrel tooling. In this condition, the tooling of both the first and second mandrel are able to further form the can body. When the second mandrel is in the second position distal the first mandrel, sufficient clearance is provided between the two tooling members to facilitate the loading and unloading of the can body onto and from the tooling.

Each working station also includes a loading mechanism that is in axial alignment with the first mandrel. The loading mechanism is axially reciprocated between a first, can acquisition elevation or position and a second elevation or position for loading and unloading the acquired can body onto and off of the first mandrel tooling member. Cam follower means are provided on the lower end of the loading mechanism and a can body support platform is disposed on the upper end of the loading mechanism. The cam follower means travels along a lift cam circumferentially disposed about the base of the column causing the loading mechanism to reciprocate between the first and second elevations. The can body support platform includes a vacuum means for positively engaging the bottom or dome portion of the can body while the loading mechanism is conveyed about the support column and is reciprocated between elevations.

After the containers are positioned onto the can body support platform, and prior to the loading of the container onto the first mandrel, the support platform begins to rotate the can body at between about 600 to 1200 rpm through the symmetric axis of the can. A sensor means identifies a timing mark that has been previously applied at a location that is proximate the lower or closed end of the can body. The mark can be an integral feature of the printed decorations on the can body side wall or applied to the bottom portion of the container. The loading mechanism includes a servo motor that is responsive to the output of the sensor means. The can body support platform rotates the can body until the timing mark is acquired. Upon acquisition, the rotation is stopped and a predetermined position of the container maintained. With the container now in a known position with respect to the female mandrel tooling, the loading mechanism completes its travel to the elevated position, loading the can body onto the female tooling. The male and female tooling complete the embossing of the can body side walls, resulting in a container in which the graphics are congruous with embossed or further formed features of the side wall.

In operation, as the turret conveys a work station about the support column, the loading mechanism support platform, at a first or lower elevation acquires a can body at the can body loading station. The can body is retained on the support platform by vacuum that maintains the can body in axial alignment with respect to the first mandrel tooling member. The support platform rotates the can body while a sensor system identifies certain indicia such as a timing mark, on the can body. Upon identification of the indicia, the rotation is stopped and held at a position with respect to the female tooling of the first or fixed mandrel. The loading mechanism, by means of the cam follower, lifts the can body up to the second elevation, inserting it over the first mandrel tooling. Thus, the first mandrel tooling member is engaged with the product side of the side wall of the container. The second mandrel is reciprocated to the first position proximate the first mandrel. The second mandrel tooling is now engaged with the consumer side of the side wall of the container. The second mandrel remains in the first position for approximately one complete rotation of both mandrels about their respective axes, then reciprocates to its second position distal the first mandrel. The can body is removed from the first mandrel tooling, preferably by means of air pressure supplied through a bore at or near the axis of the first mandrel. The loading mechanism re-engages the bottom of the can body, preferably with the benefit of a vacuum system and lowers the can body to the first elevation. The turret continuing its rotation about the column positions the loading mechanism at a can body discharge station. An inspection system is preferably disposed prior to the discharge station and includes means for evaluating the quality of the embossed can body and rejecting the same in the event that the further formed features are not in alignment with the graphics. In the event of misalignment, the rejected can is ejected from the loading mechanism prior to its arrival at the discharge station. It should be appreciated that the turret is supplied with a plurality of embossing stations, preferably twelve to twenty-four individual stations, so that each rotation of the turret can further form multiple can bodies in a continuous operation.

BRIEF DESCRIPTION OF THE DRAWINGS

The above as well as other features and advantages of the instant invention can be appreciated through consideration of the detailed drawings in which.

DETAILED DESCRIPTION OF A PREFERRED EMBODIMENT

Figure 1:
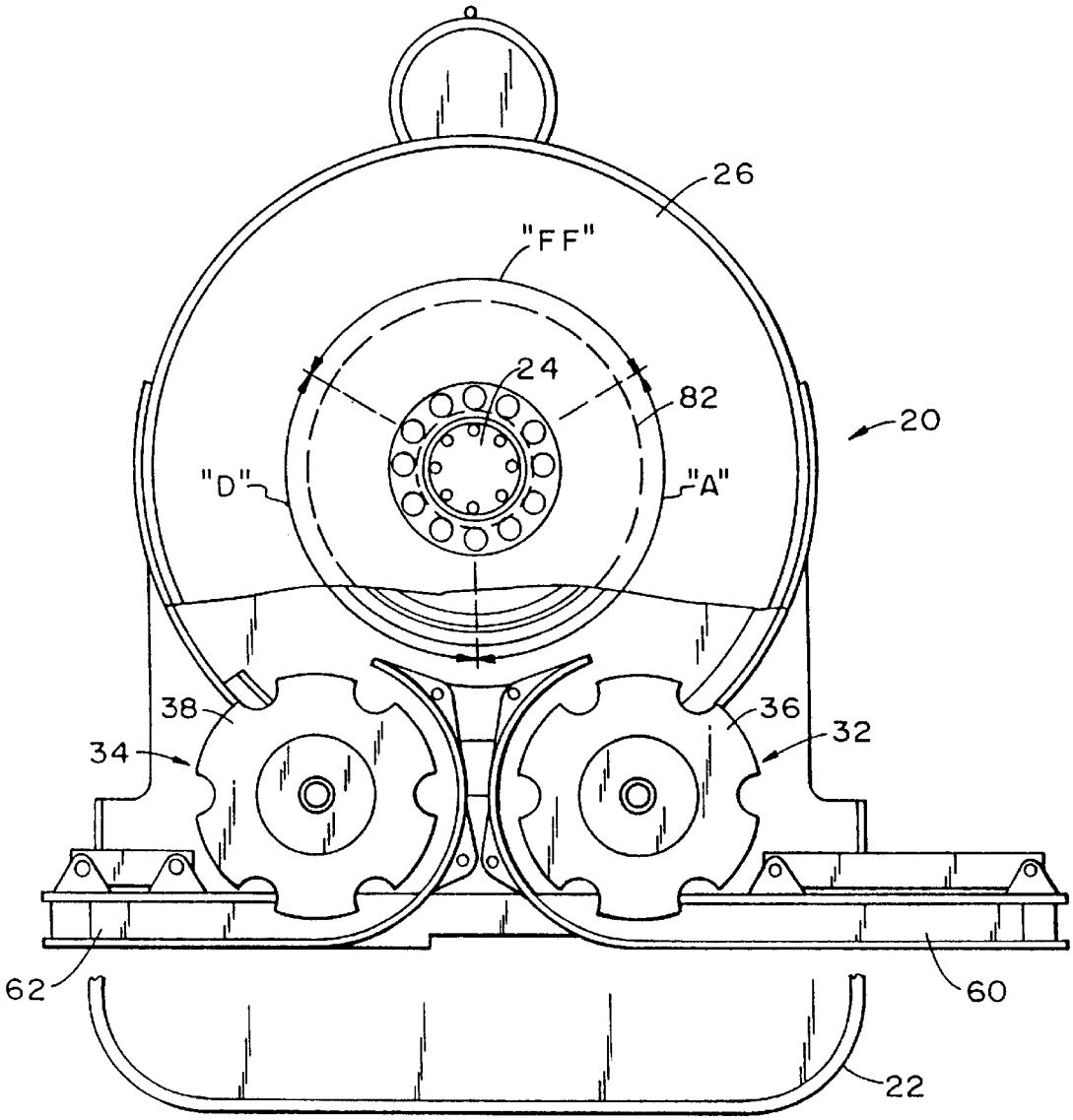
FIG. 1 is a schematic plan top view with parts thereof broken away showing the processing apparatus constructed in accordance with the present invention.
Figure 2:
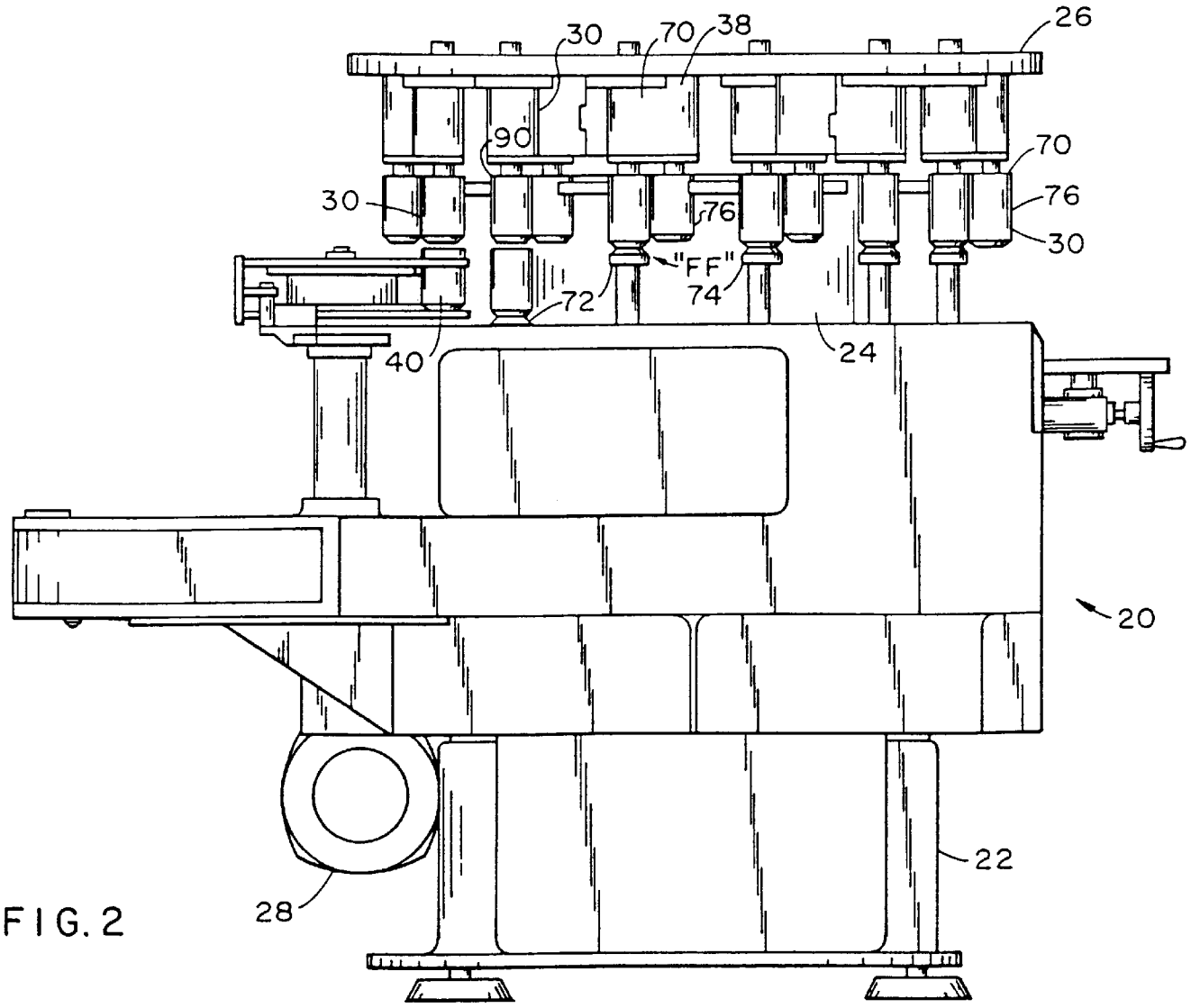
FIG. 2 is a side elevation view of the apparatus shown in FIG. 1.

FIGS. 1 and 2 schematically illustrate in top plan and side elevation view, respectively, a container processing apparatus generally designated by the reference character 20. The apparatus 20 consists of a base 22 that has a center post or column 24 on which is supported a rotatable turret 26. The turret 26 is rotated about the center column 24 through a conventional drive means 28 mounted on the base 22. The turret 26 has a plurality of substantially identical processing stations 30 mounted about the periphery thereof. Preferably, the turret includes between twelve and twenty-four such stations. However, the number of stations can be readily increased or decreased to accommodate production efficiencies.

Figure 3:
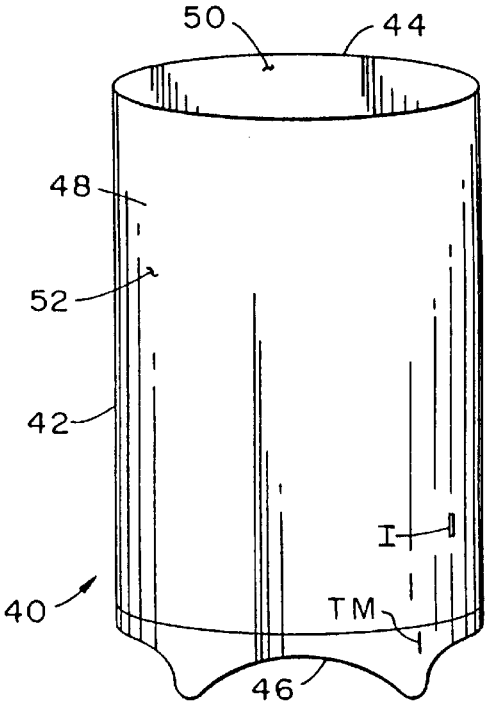
FIG. 3 is a side elevation view of the can body portion of a conventional two piece beer and beverage container prior to the application of the embossing or embossing process of the present apparatus.

Turning to FIG. 3, a conventional can body from a two piece beverage container that is well suited for embossing in the apparatus of this invention is generally indicated by the reference character 40. The container 40 consists of a can body portion 42 with an open end 44. The body portion 42 includes a bottom portion 46 and a continuous side wall 48 having a beverage side 50 and a public side 52.

The can body or container 40 is delivered to the processing apparatus 20 through an infeed mechanism 32. In a conventional can manufacturing line, the present apparatus can be positioned such that the can body is subject to the embossing process of this invention prior to the necking and flanging operations. The containers are removed from the processing apparatus subsequent to embossing through a discharge mechanism 34. The infeed mechanism 32 can incorporate a conventional star wheel mechanism 36 or the like that has a plurality of periphery pockets for receiving containers from a continuously moving conveyer 60 for delivery to each of the embossing stations 30. The discharge mechanism 34 can include a second star wheel mechanism 38 or the like that also has pockets for receiving the further formed containers from each of the stations for ultimate delivery to the continuously moving conveyor 62. The further formed cans are transported for further processing and filling in the can line.

As shown in FIGS. 1 and 2 each station 30 incorporates a first or fixed mandrel 70, a loading mechanism 72, and a second or moveable mandrel 76. The loading mechanism 72 includes a loading platform 74 which is vertically reciprocated within an opening in the turret 26 through a lift cam located along the base of the system. As the turret conveys an embossing station 30 through the can acquisition and ultimately can discharge positions, the loading mechanism platform 74 is maintained at a first elevation. The portions of the rotational travel of the turret through which the platform is maintained at the first elevation are typically the first and last 120 degrees of travel of the turret. As shown in FIG. 1, the acquisition zone of turret travel is generally indicated by the character "A" and the discharge zone of the turret is generally indicated by the reference character "D". During travel through the acquisition zone "A", the container is held onto the platform by vacuum and is rotated by the platform to a position of orientation with respect to a predetermined set of criteria as will be described below prior to being received onto the first mandrel 70. One of the predetermined criteria necessary for the orientation of the can body is the presence of indicia such as in the form of a timing mark or a feature in the graphics of the can body's decoration. It is to be appreciated that the can body has been decorated at a prior station by conventional means to include thereon a suitable positioning or timing like mark inconspicuously incorporated into the graphic decorations. The remaining approximately 120 degrees of rotational travel of the turret 26 are characterized as the embossing zone "FF". It will be appreciated that through a modification of the lift cam and an adjustment of the revolutions that the first mandrel makes per single revolution of the turret about the column, the dimensions of the several zones can be expanded or contracted. While an embossing station is traversing the embossing zone (FF in FIG. 1), the platform is elevated from the first position and maintained at a second higher elevation to accomplish the loading, forming, and unloading functions. In other words, the lift cam maintains the platform at a first elevation at the can acquisition and can discharge stations and sequentially raises and then lowers the platform up to and down from a second elevation for the embossing of the can body.

Figure 4:
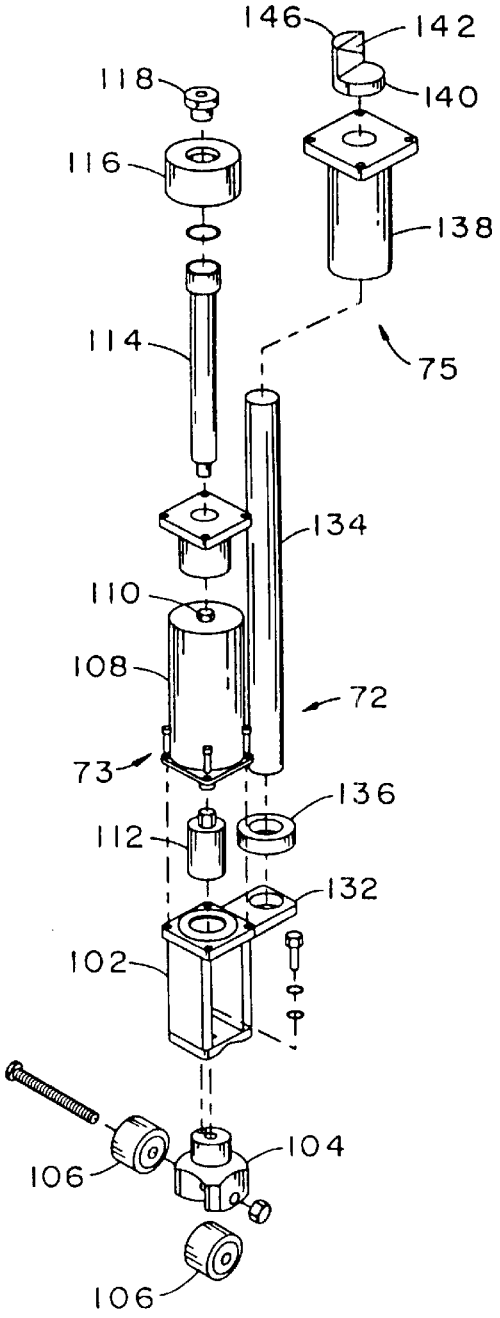
FIG. 4 is an side elevation, exploded view of a can body loading and registration mechanism.

Turning to FIG. 4, the lift pad rotation and registration assembly 72 consists of two major subassemblies, a can body rotating platform mechanism 73 and a sensor platform 75. The rotating platform mechanism 73 includes a lift pad frame 102 having a lower end on which is mounted a lower lift rod support mechanism 104. A cam follower 106 is mounted for rotational movement in the lower lift rod support mechanism 104. The top of the lift pad frame 102 supports a servo motor 108. The servo motor 108 includes a centrally disposed passage 110 therethrough. The lower portion of the servo motor passage 110 is in communication with a rotary union 112. The upper end of the passage 110 is in communication with a rod support member 114 on which is mounted at the upper end thereof a lift pad 116. The passage 110 of the servo motor in conjunction with the hollow lift rod 114 provides means for applying negative pneumatic pressure onto the bottom of the can via the lift pad 116. The lift pad 116 includes thereon an orifice 118 having a surface adapted to allow the seating of a can body thereon. Ideally, the servo motors will rotate a container body at between 600 and 1200 rpm in order to quickly locate the timing mark and position the can body in the appropriate aligned position with respect to the tooling.

The second subassembly on the lift pad assembly is the sensor platform 75. The lift pad frame 102 includes a cantilevered member 132 on which is supported a torque rod 134. The torque rod can be fastened at a predetermined elevation by means of a set collar 136. A sensor mounting platform 138 is affixed to the upper end of torque rod 134. Sensor means 140 including a laser light source 142 and detection means as at 146 for detecting the reflected laser light or absence thereof. Appropriate amplifiers and other electronic equipment, all of which is commercially available, are supplied in order to use the detected signal as a means for indicating the desired location of the cylindrical can body relative to the tooling members.

A preferred sensor means is a laser fiber optic sensor of the type commercially available from Keyence Corporation and identified by the manufacturer as FS-L71. The laser identification system provides a source of laser light that is directed toward the indicia and a detector means responds to the presence or absence of laser light reflected from the can body. The laser identification system, upon locating the timing mark, generates an output signal indicative of the same. The laser identification output signal is then communicated to an appropriate amplifier and indexing system consisting of a motor and a motor controller. Suitable motor and drive systems are commercially available from Industrial Indexing Systems. The controller which initiates the rotation of the support platform stops the rotation at a desired location. As a result, the can body is positioned so that the embossing of the can body side wall is coordinate with the overall graphics that were previously applied to the can body.

Thus a container is delivered from a feed mechanism 32 to a loading mechanism 72 while the loading platform 74 is in the first or lowered position. As the platform is elevated, the can body is mounted onto a tooling member 90 of the first or fixed mandrel 70. A mechanism for moving the platform 74 between the two desired elevational positions may be of the type shown in U.S. Pat. No. 4,519,232 incorporated herein by reference as if fully set forth.

Figure 5:
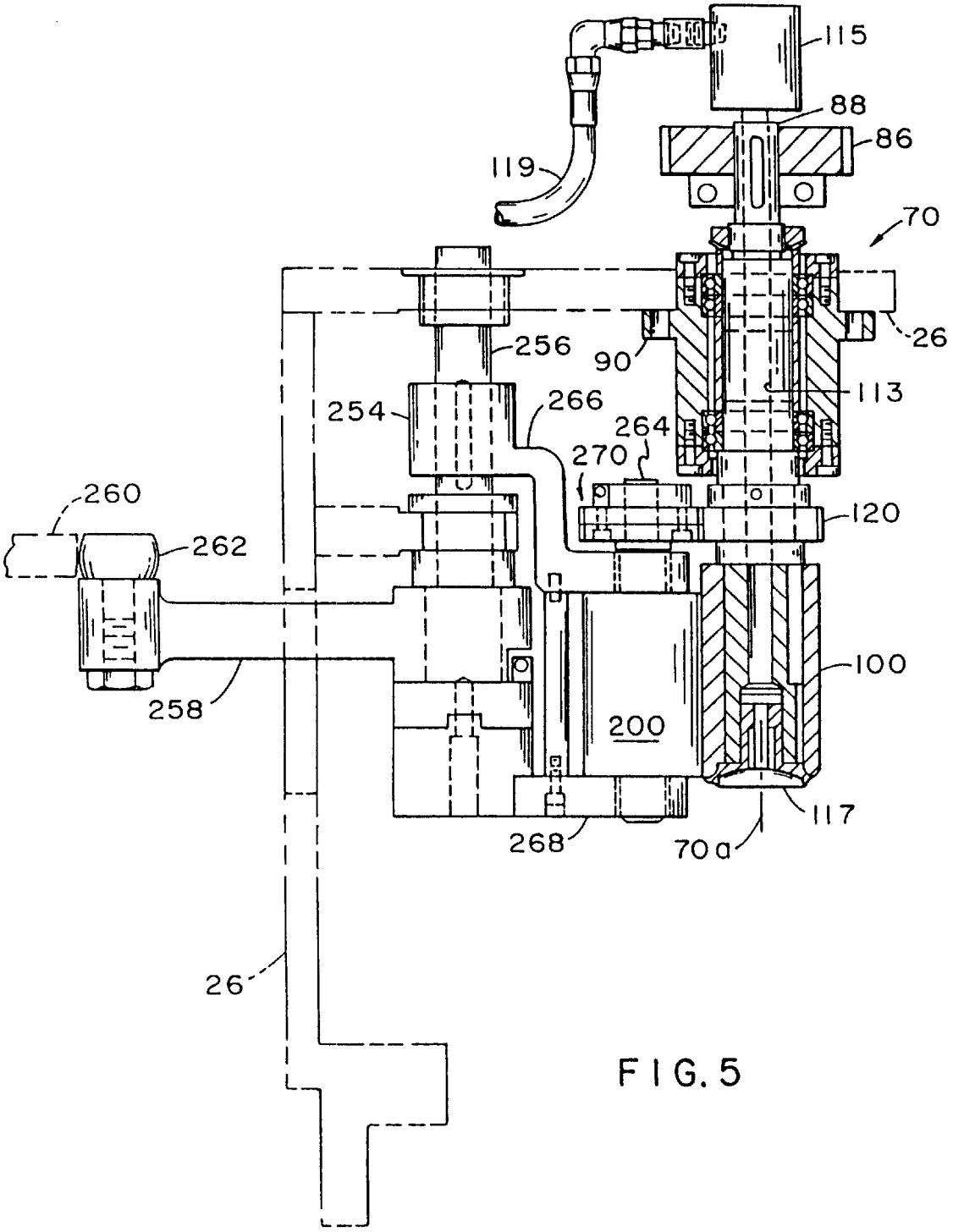
FIG. 5 is a side elevation view of the fixed and movable mandrels of this invention with portions shown in section.
Figure 6:
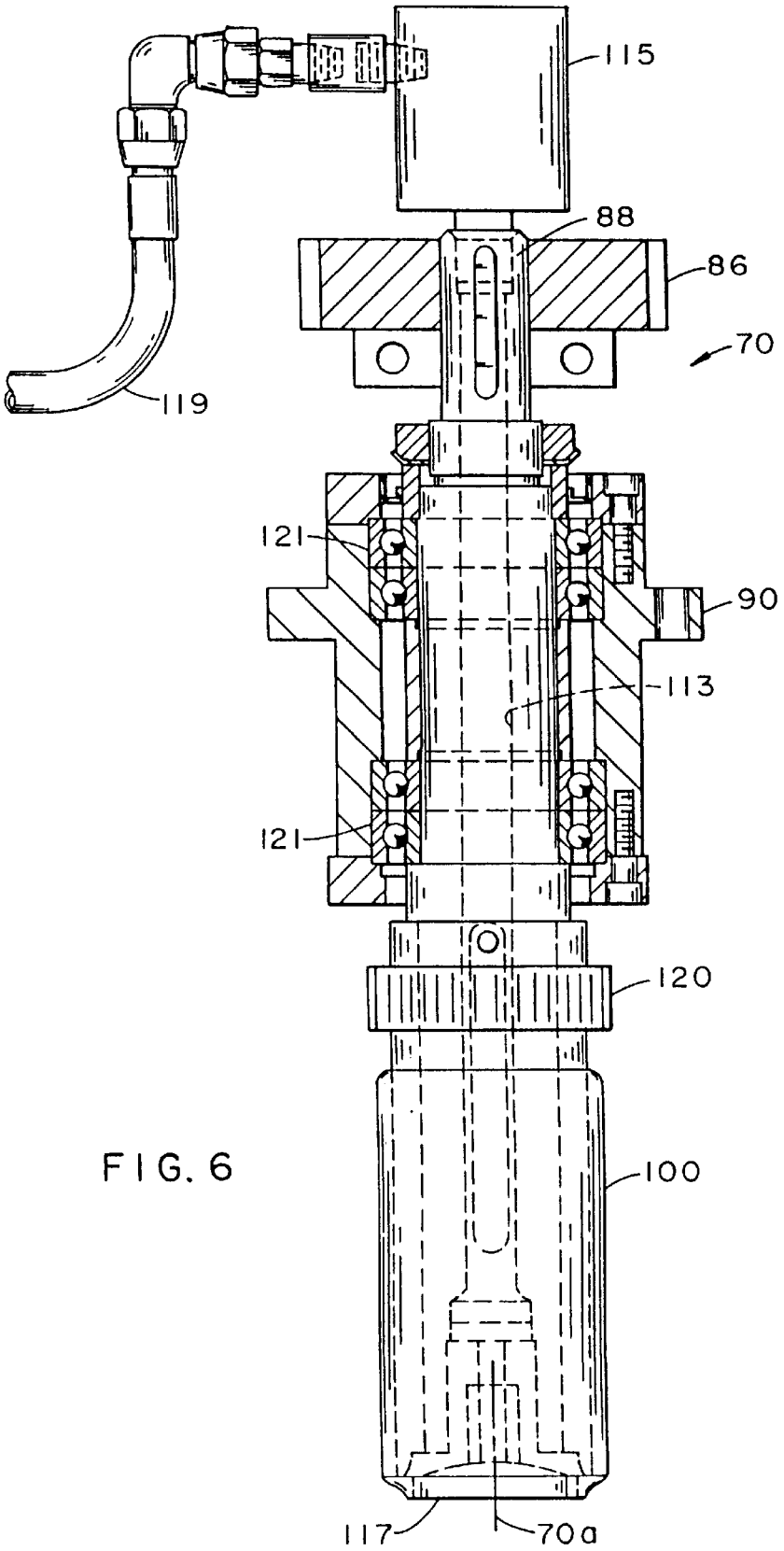
FIG. 6 is a side elevation view of the fixed mandrel with portions shown in section.
Figure 7B:
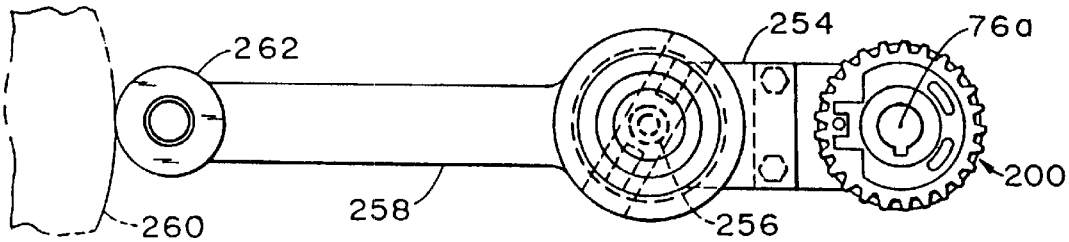
FIGS. 7A and 7B are a side elevation view and a plan view of the movable mandrel of this invention with portions shown in section and in phantom.
Figure 7A:
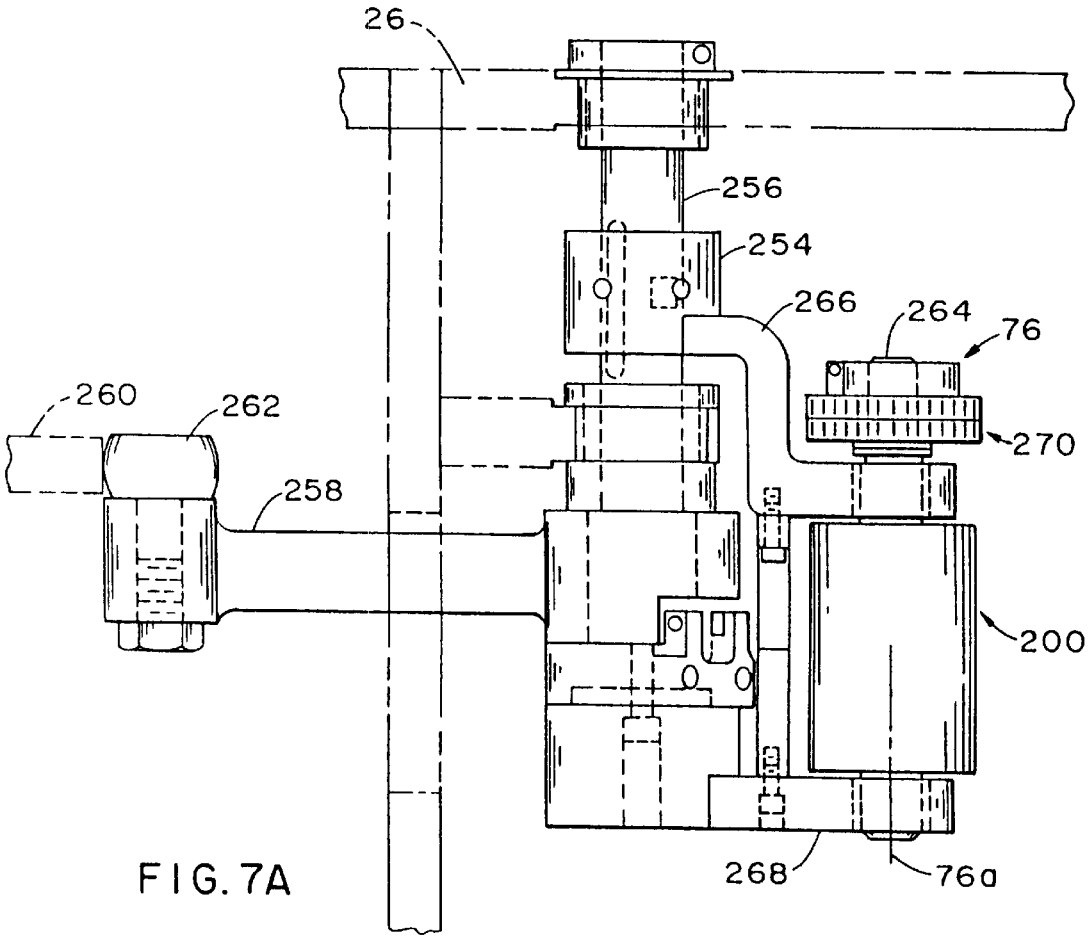

A first or fixed mandrel 70 and a second or reciprocating mandrel 76 are shown in detail in FIGS. 5, 6, and 7. Each mandrel supports its own tooling member which together work in concert to emboss the side walls of a container body. The fixed mandrel 70 is mounted for rotation about an axis 70*a* that is directly above and in alignment with the lift pad assembly 72. The first mandrel 70 is rotationally driven about its fixed axis by means of a gearing system. The gearing system consists of a first fixed or sun gear 82 that is mounted on the column 24 (See FIG. 1), and a second fixed or planetary gear 86 fixedly mounted onto the shaft 88 of the mandrel 70. The shaft 88 is rotationally mounted in the housing 90 that is mounted (not shown) onto the turret 26. This arrangement creates a planetary gear drive system in which each embossing station has a planet gear that is driven by the fixed sun gear 82 as the turret rotates about the column. The mandrels, which are rotatably mounted at each of the work stations, are driven at a 3 to 1 ratio relative to the rotary turret. In other words, as the turret completes one full rotation about the column, each mandrel is rotated three times. As will be appreciated, 120° of travel by the turret represents the distance required to further form the can after the mandrels completely engage the can body. While in the preferred embodiment each mandrel makes one complete revolution through each 120° of travel of the rotary turret, it is possible to complete one full rotation of the mandrel in fewer degrees of travel by adjusting the ratio of the planetary gearing system. Doing so would subsequently impact the period of time during which the can bodies are loaded and unloaded from the embossing station.

Considering FIG. 6 in detail, the first mandrel 70 is supported within housing 90 for rotational movement facilitated by bearing means 121. The first member is "fixed" in the sense that it rotates about an axis that is in a fixed position with respect to the embossing station in which it is mounted. The fixed mandrel 70 supports a first tooling member 100. This tooling member 100 is also referred to as a female tooling member because of its configuration. The support shaft 88 includes a central bore 113 therethrough, extending from the rotary union 115 to the nose piece 117 of the female tooling member 100. Central bore 113 provides a passage through which pressurized air is provided to eject a can body from the female tooling subsequent to the completion of the embossing operation. A supply of pressurized air (not shown) is delivered through conduit means 119.

Turning to FIG. 7, the second or movable mandrel 76 is mounted for rotational movement about an axis 76*a* that reciprocates toward and away from the first or fixed mandrel 70. The movable mandrel 76 supports a second or male tooling member 200. The male tooling member 200 cooperates with the female tooling member 100 to effect the embossing of the side walls of the container. The female tooling member has a surface that defines one or more recessed portions therein and the male tooling member has a surface that defines one or more protuberances extending therefrom and adapted to correspond with the recessed portions of the female tooling. The continuous side wall of the can body is conveyed between the male and female tooling members in order to emboss features into the side wall of the can body in a manner to be described in detail below. A main pivot arm assembly 254 is supported for reciprocating rotational motion about the mains support shaft 256. The pivot arm assembly 254 is in fixed mechanical communication with a lever cam arm 258. At one end of the arm distal the second mandrel 76 is a cam follower 262. The cam follower is conveyed by means of the turret assembly 26, and follows along a cam surface 260 (shown in phantom in FIGS. 5 and 7) on the column. The cam surface mounted within the apparatus has a profile consistent clearance necessary to load and unload the can body from the fixed mandrel. The clearance is approximately 0.008 inches. The elevated portion of the cam profile is adapted to effect the reciprocal motion of the second, movable member toward and away from the fixed mandrel. As described above, the ratio of the rotation of the fixed mandrel with respect to the rotation of the turret about the column will impact the cam profile of the cam surface 260. Additionally, means can be provided to adjust the relative position of the pivot arm assembly 254 with respect to the lever cam arm 258 so as to adjust the ultimate position of the second or male tooling member 200 when it is in its pinch point position with respect to the female tooling member 100. The movable mandrel 76 is fixedly mounted onto shaft 264 which is supported at its upper and lower end by arms 266 and 268 which are extensions of the pivot arm assembly 254.

Figure 11:
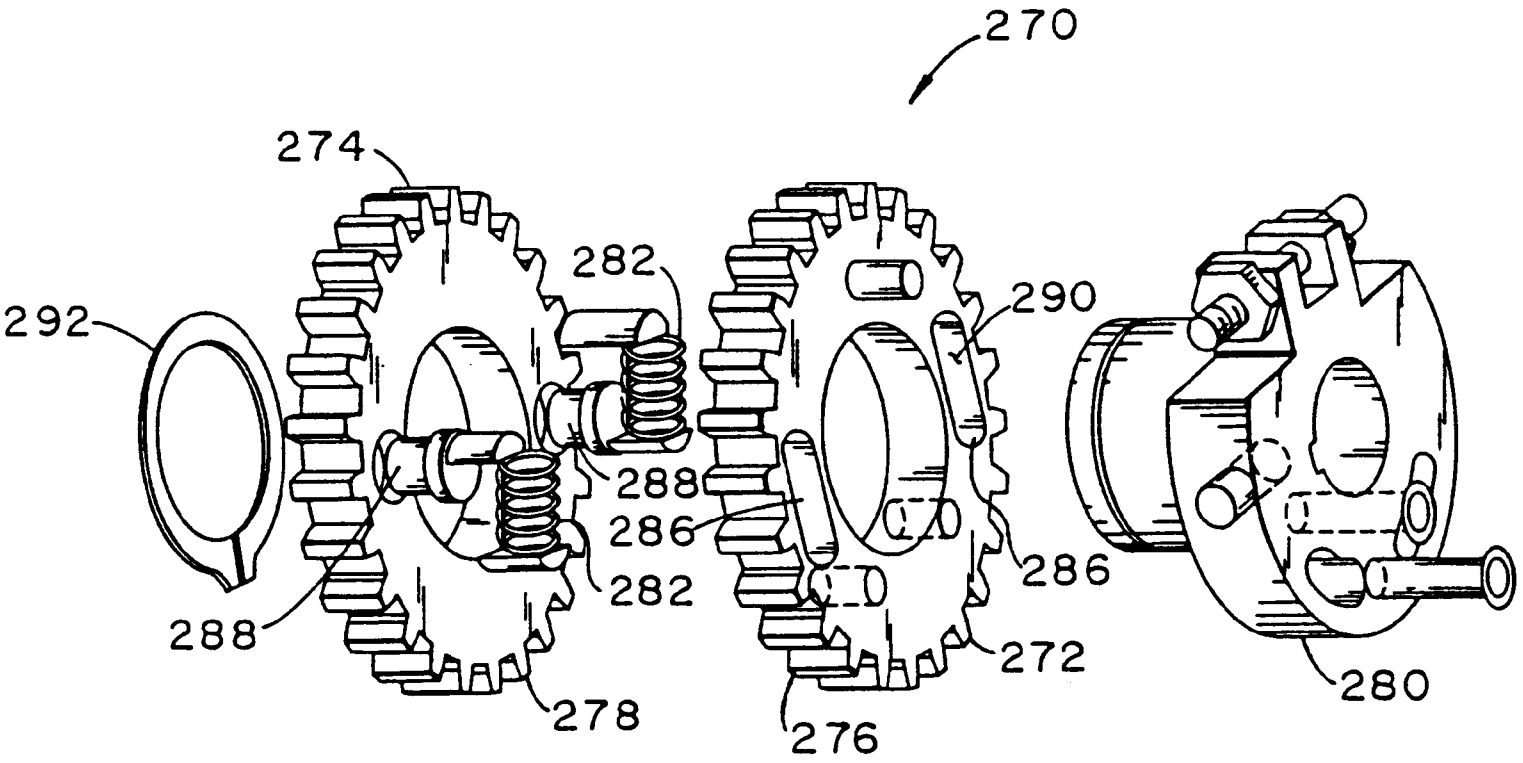
FIG. 11 is an exploded view of the anti-backlash gear assembly, all according to the instant invention.

At the uppermost end of shaft 264 is mounted an anti-backlash assembly 270. The anti-backlash assembly 270 as shown more clearly in FIG. 11 includes first and second gear member 272 and 274 that have substantially identical gear teeth 276 and 278 respectively. Gear member 272 is keyed to the hub 280 and fixedly attached to the shaft 264 so that rotation of the gear 272 effects the rotation of the male tooling member 200. The anti-backlash assembly 270 functions as a spur gear that is in mechanical communication with the spur gear 120 on the shaft 88 of the fixed mandrel 70. Rotation of the first mandrel 70 through the planetary gear arrangement described elsewhere herein effects the rotation of the spur gear 120 which in turn is in mechanical communication with the anti-backlash assembly 270 of the movable mandrel 76. This gearing arrangement maintains the uniform rotation of the fixed and movable mandrels as the embossing station with which they are associated is conveyed by the turret around the column.

In the anti-backlash assembly, the second gear member 274 is mounted for limited rotational movement with respect to first gear member 272 on shaft 264. Once the anti-backlash assembly 270 is engaged with spur gear 120, rotational displacement of the second gear 274 with respect to the fixed, first gear 272 is effectively limited to the pitch of the teeth in gear member 120. The gear assembly 270 includes a biasing means such as spring members 282 mounted between the gears 272 and 274. Slots 286 are provided in the face of gear 272 and spring support posts 288 extend from the face of gear 274 into slots 286. The spring members 282 are compressed between the spring support posts 288 and the side walls 290 of slots 286. Retaining ring 292 retains the second gear 274 on the shaft 264. When assembled, the anti-backlash assembly urges the teeth 276 of gear 272 and the teeth 278 of gear 274 into a rotationally spaced or misaligned relationship with respect to each other. The result is that the effective pitch of the gear assembly, that is, the distance between one point on a gear tooth and the corresponding point on the next gear tooth as measured parallel to the axis of the gear assembly, has been reduced. When the movable mandrel 200 is in a position proximate the fixed mandrel 100, the anti-backlash gear operates as a standard spur gear. As the movable mandrel reciprocates to the position distal the fixed mandrel 100, the biasing means 282 of the anti-backlash assembly 270 urges the second gear member 274 out of alignment with first gear member 272, reducing the relative pitch between the teeth 274 of the first member and the teeth 276 of the second gear member. With the anti-backlash gear in this "open" position, the relative rotational position of the first mandrel with respect to the second mandrel is maintained. As the second mandrel reciprocates back toward the first mandrel, the first and second gear members 272 and 274 are urged back into alignment by the fixed pitch of the teeth of the spur gear of the fixed mandrel. The spring loading of the anti-backlash gear member maintains the timing between the mandrels. The spur gears on the male and female mandrels move apart, but never completely separate. It is to be appreciated that the reciprocal motion of the second mandrel from the first mandrel need only be enough to provide the clearance necessary to load and to unload the can body from the female tooling of the first or fixed mandrel. In that the current thickness of a can body is approximately 0.004 to 0.006 inches thick, the clearance necessary to load the can body onto the mandrel is relatively small.

After the can has made one revolution through the male and female tooling so as to emboss the can with a full 360° of embossing, the can is removed from the female tooling. To assist in the removal or unloading, compressed air is provided through the female mandrel as described elsewhere herein. The triggering of the air feed can be done by mechanical switching that reflects the relative position of the turret station with respect to the embossing process. As the compressed air ejects the can from the mandrel and towards the loading mechanism of the lift pad assembly, the vacuum supply to the lift pad is applied to recapture the can. The lift pad maintains vacuum on the bottom of the can while lowering the can to its original height for discharge from the embossing apparatus. In the event that a can has become misaligned during the course of the embossing process, this misalignment will be detected by the sensor system. Upon detection of misalignment, the can can be removed from the lift pad into an appropriate discharge apparatus. As illustrated in FIG. 1, the lift pad continues its rotation with the turret depositing the can onto a discharge wheel or similar discharge apparatus.

Figure 8B:
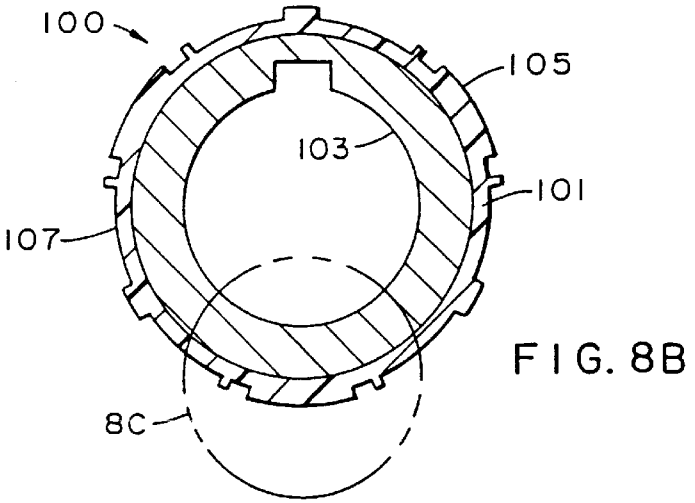
FIGS. 8A, 8B, and 8C are side elevation, sectional, and partial detail views of the female tooling of this invention.
Figure 8C:
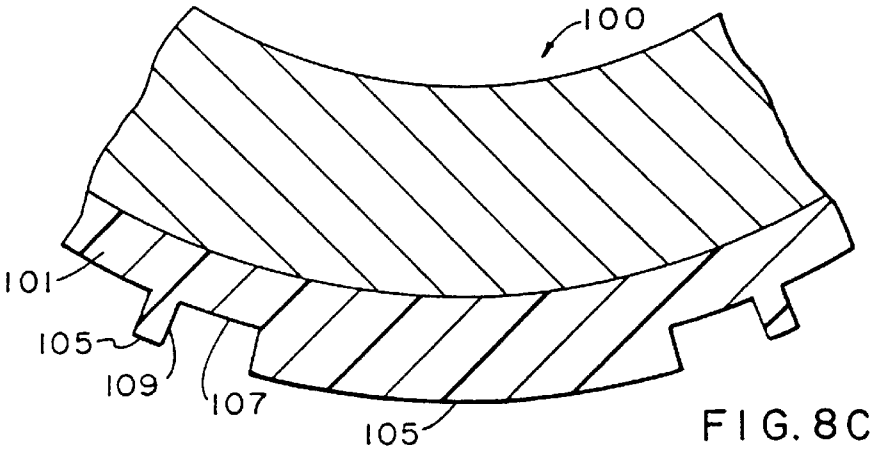
Figure 8A:
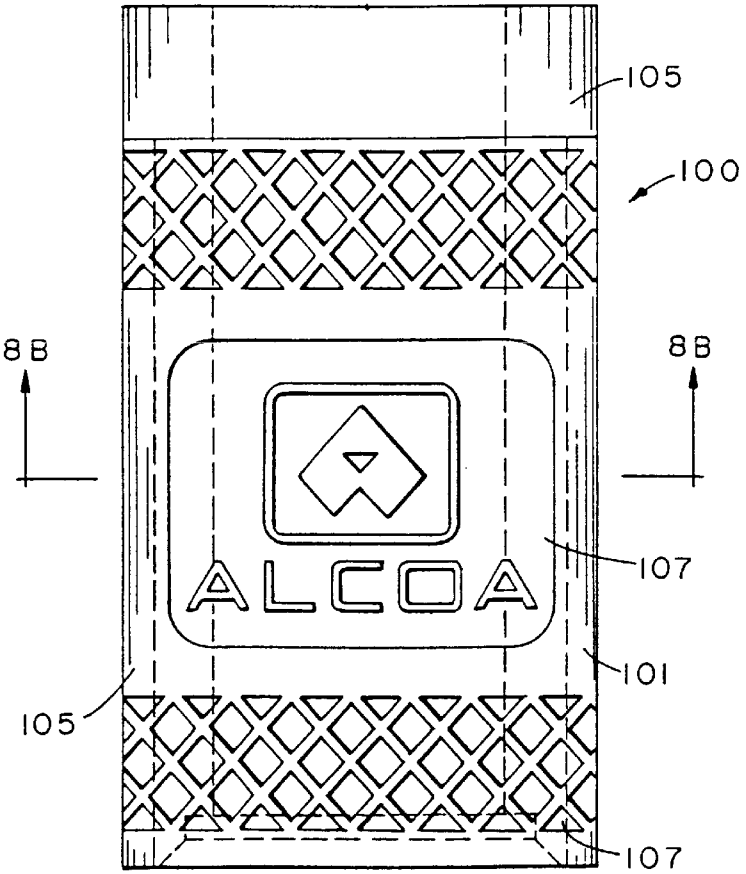

Turning to FIGS. 8, 9, and 10, the female and male tooling 100 and 200 respectively are shown in greater detail. Both the male and female tooling members are made preferably from a polymer material such as polyurethane that exhibits desirable wear and acceptable formability characteristics. Considering first FIGS. 8A, 8B, and 8C, there is illustrated a female tooling member 100 with a cylindrical body portion 101. As can be seen in FIG. 8B, the cylindrical body 101 has a central bore 103 therethrough that is adapted to cooperate with the support shaft 88 (FIG. 6) of the first mandrel 70 for the mounting of the tooling there on. The maximum outside diameter of the female tooling member is slightly less than the inside diameter of the can body to be inserted onto it for embossing. The outside diameter of the tooling is defined by the outer most surface 105 of the cylindrical body 101. Numerous reliefs 107 are made in the surface of the cylindrical body. As portions of the surface material are removed from the cylindrical body, a pattern can be formed in the tooling member. One exemplar of such a pattern is shown in FIG. 8A in which the trademarks of the assignee are present on the female tooling. The female tooling is in a sense the equivalent to a positive image in photography. The pattern shown in FIG. 8A is, as mentioned, only one example of the vast variety of configurations that can be produced in a female tooling member. It has been found that an appropriate method of forming the tooling is through the use of laser engraving. Extending between the surface 105 of the tooling member and the relief portion 107 are side wall portions 109.

Figure 9B:
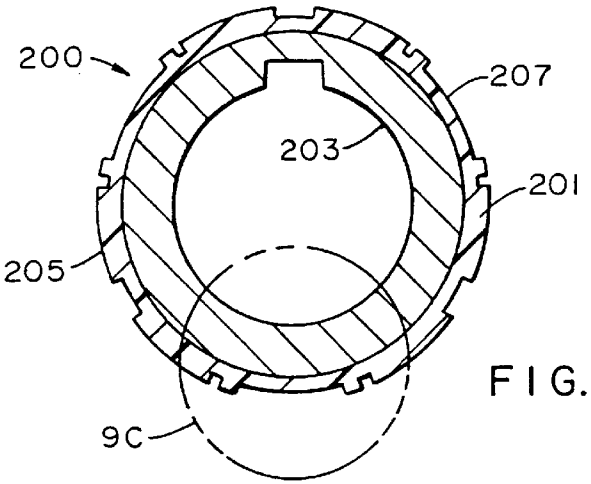
FIGS. 9A, 9B, and 9C are side elevation, sectional, and partial detail views of the male tooling of this invention.
Figure 9C:
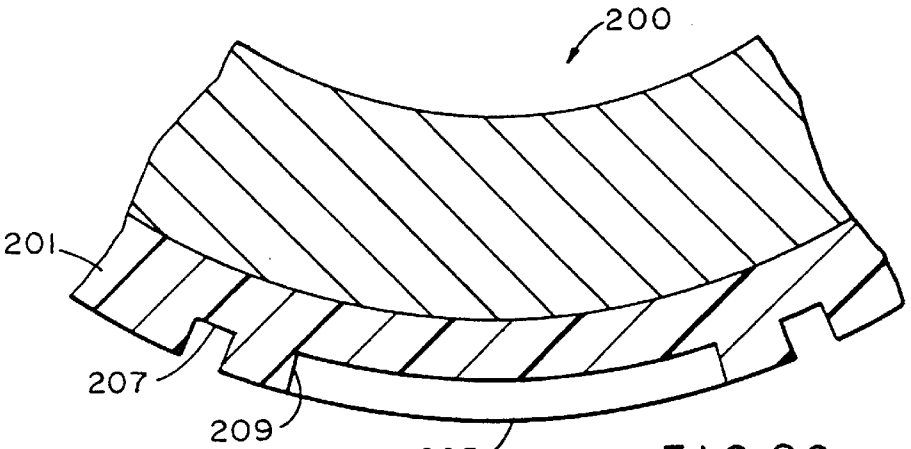
Figure 9A:
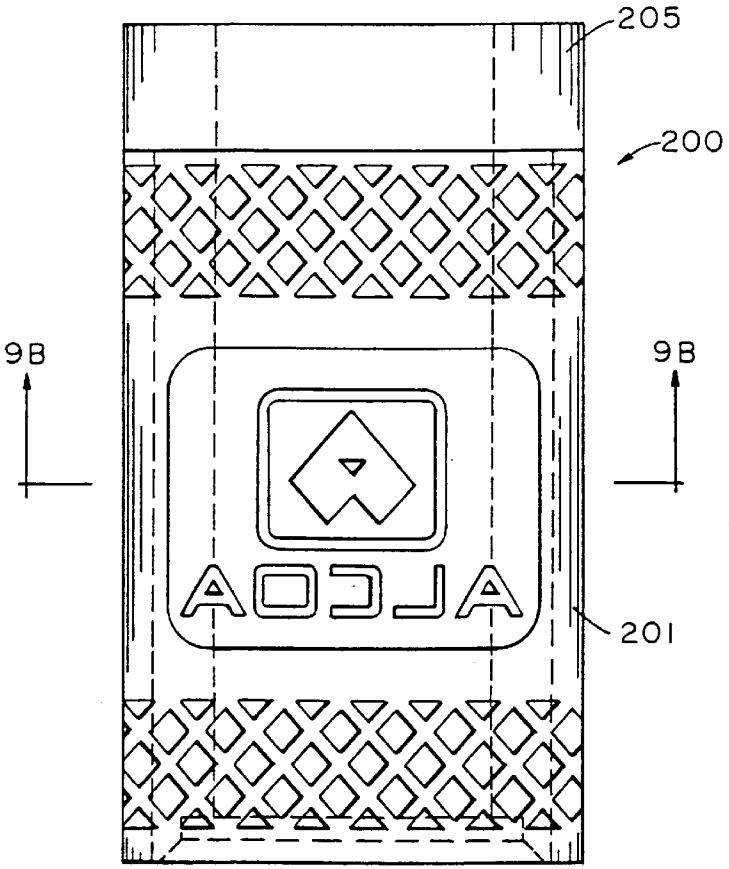
Figure 10A:
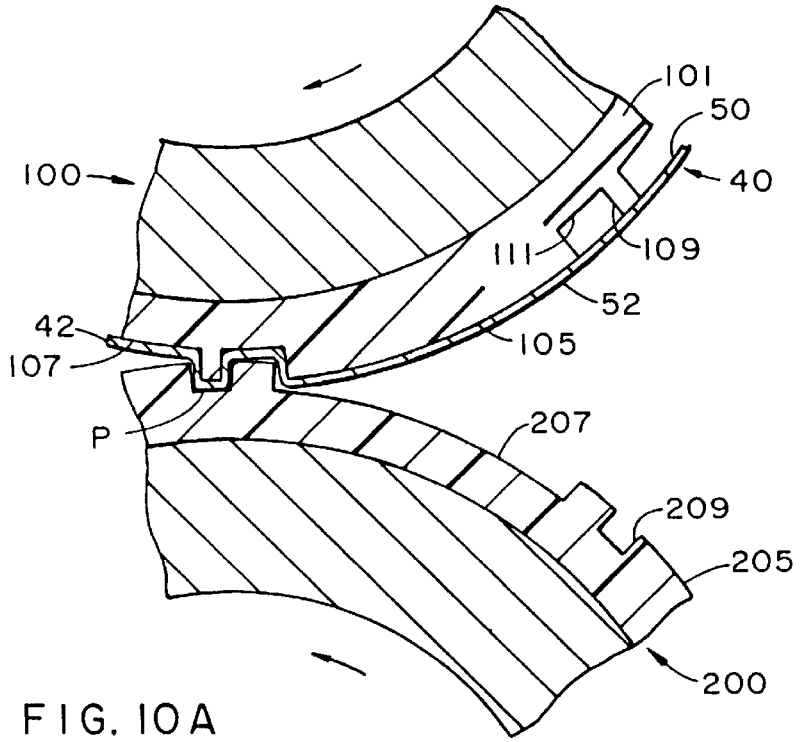
FIGS. 10A and 10B are cross sectional views of a portion of the tooling illustrated in FIGS. 8 and 9 engaging a can body for the embossing thereon.
Figure 10B:
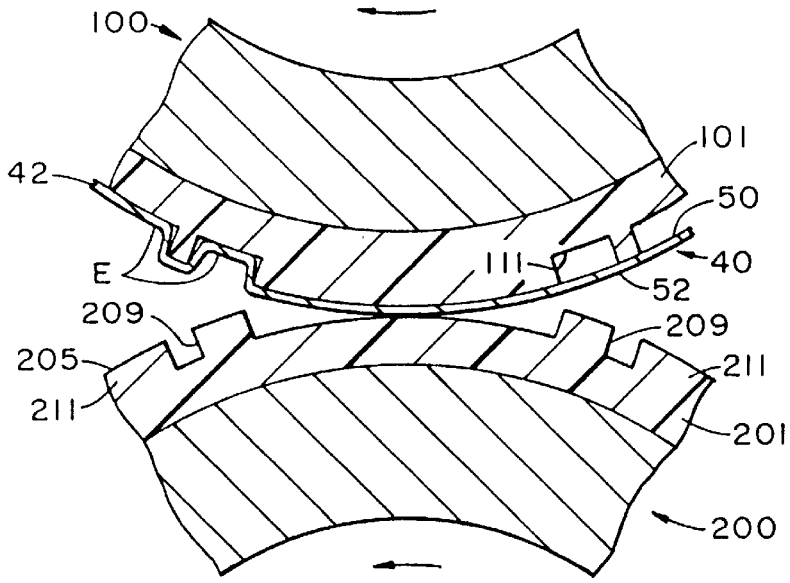

Turning to FIGS. 9A, 9B, and 9C, male tooling member 200 comprises a cylindrical body portion 201 having therein a central bore 203 adapted for mounting the cylindrical tooling member onto the shaft 264 of the reciprocating mandrel 76. The male tooling member is the equivalent of the negative in photography in that the appearance of graphics are reversed. This can be seen by the appearance of the lettering of the assignee's trademark in FIG. 9A. The male tooling member includes numerous protuberances 205 and relief portions 207. Extending there between are walls 209. Turning to FIGS. 10A and 10B, the manner in which the male and female tooling members cooperate to emboss a can body can be readily appreciated.

After a cylindrical container 40 is inserted over the female tooling member 100, the reciprocating mandrel presents the male tooling into a pinch point relationship with the female tooling shown in FIG. 10A, as the tooling members rotate with respect to each other, the female tooling member 100 is rotating in a clockwise direction as seen in FIG. 10*a* and the male tooling in a counterclockwise direction. The container side wall has a thickness of approximately 0.004 to 0.006 inches. This can be seen in FIG. 10*a* as the pinch point indicated by the reference character P embosses the container side wall 42. Sufficient clearance is provided between the male and female tooling member to allow the container side wall to be further formed by the tooling. The clearance also is sufficient to compensate for the pitch differential between the protuberances generally indicated by the reference character 211 in the male tooling and the recessed portions 111 of the female tooling member 100. Preferably, the protuberances of the male tooling member are approximately 0.010 inches reduced in all directions with respect to the corresponding recessed portions 111 of the female tooling member. In a preferred embodiment, the protuberances of the male tooling engage and emboss the container side wall to a depth of between 0.012 and 0.20 inches. It is believed that the combination of the clearance described above and the use of a polyurethane tooling provides sufficient clearance between the tooling members so as to avoid unnecessary strain on either the container's side wall during the embossing operation or the tooling members features, i.e., the recessed portions and the protuberances.

The inventors have found that a container that has further formed side walls in accordance with the tooling of this invention is capable of withstanding the internal pressures typically associated with carbonated beverages. Moreover, even while under such pressures, the further formed can of this invention retains embossed features of the container side wall. In other words, the embossed features remain visible and pronounced to the touch, even while the contents of the container are under pressure. Another feature resulting from the tooling of this invention is that the portions of the container side wall proximate the embossed locations creates the appearance of being a raised portion of the container side wall. The result is a multi-dimensional effect on the container that presents a pleasing and attractive surface appearance of the container to the consuming public. A variety of embossed features as indicated by the reference character E on FIG. 10B can be incorporated into a can body to provide a can body that has the appearance of the female tooling member illustrated in FIG. 8A. It is to be appreciated that by modifying the relative depth of a relief portion on a female tooling member while increasing the relative height of a corresponding protuberance in the male tooling, a multi-dimensional embossing effect to container side wall is possible. Thus certain features may be more or less pronounced according to the depth and height of the tooling features, rendering a distinctive packaging product.

What has been described is an apparatus for the embossing of the side wall of a container. While the foregoing invention has been described and illustrated with specific embodiments, it will be understood that the inventions entitled to protection within the full scope of the appended claims.

What is claimed is:

1. A method for prepositioning and loading a can body onto a rotating tooling member having a known orientation, said can body having previously applied decorations thereon, said method comprising the steps of:

(a) providing indicia as a part of said previously applied decorations at a predetermined location on the decorated can body;

(b) rotating said decorated can body;

(c) providing indicia recognition means permitting the identification of the indicia provided on the decorated can body, said indicia recognition means generating an output signal reflective of such identification;

(d) responsive to said output signal, aligning said decorated can body so that said decorated can body is in a desired orientation relative to the known orientation of the rotating tooling member;

(e) mounting said aligned can body onto the rotating tooling member, wherein said the decorations on said can body are in a predetermined position with respect to the tooling member.

2. An apparatus for the further forming of a decorated can body in which the decorations include an identifiable indicia thereon such that the further forming thereof is congruous with the decoration, said apparatus comprising:

a first working member mounted for rotational movement and adapted to receive thereon the can body;

a second working member mounted for synchronized rotational movement with respect to said first rotating working member and reciprocally movable from a first position distal said first working member to a second position proximate said first working member, wherein in said second position, the can body side wall is engaged between said first working member and said second working member;

means for rotationally supporting the can body and for loading the can body onto the first rotating working member;

indicia detection means in electrical communication with said means for rotationally supporting the can body, said detection means being responsive to the indicia and generating an output signal indicative of the position of the rotating can body with respect to the first working member; wherein said means for rotationally supporting the can body orients the rotationally supported can body relative to the first rotating working member prior to the loading of the rotating can body onto the first rotating working member.

3. The apparatus according to claim 2 wherein the indicia detection means is a laser fiber optic sensor that generates an output signal response to the acquisition of the indicia.

4. The apparatus according to claim 3 wherein the indicia detection means includes a fiber optic sensor and the means for rotationally supporting the can body includes a servo mechanism that is responsive to the output signal of the fiber optic sensor.

5. The apparatus according to claim 4 wherein the means for rotationally supporting the can body further includes means for unloading the can body from the tooling member.

6. The apparatus according to claim 5 wherein the means for loading and means for unloading the can body onto and from the tooling member is a cam activated lift platform.

* * * * *

UNITED STATES PATENT AND TRADEMARK OFFICE

CERTIFICATE OF CORRECTION

PATENT NO. : 5,941,109

DATED : August 24, 1999

INVENTOR(S) : Brian D. Johnson et al.

It is certified that error appears in the above-identified patent and that said Letters Patent is hereby corrected as shown below:

Col. 12, line 35, Claim 4 After claim, delete "3" and insert --2--

Signed and Sealed this

Eighth Day of February, 2000

*Attest:*

*Attesting Officer*

Q. TODD DICKINSON

*Commissioner of Patents and Trademarks*